US012110911B1

(12) United States Patent
Scott et al.

(10) Patent No.: US 12,110,911 B1
(45) Date of Patent: Oct. 8, 2024

(54) EJECTOR WITH INTEGRATED ISOLATION VALVE

(71) Applicant: United Launch Alliance, L.LC., Centennial, CO (US)

(72) Inventors: Joel Cy Scott, Lone Tree, CO (US); Jeffrey J. Rogers, Littleton, CO (US)

(73) Assignee: United Launch Alliance, L.L.C., Centennial, CO (US)

( * ) Notice: Subject to any disclaimer, the term of this patent is extended or adjusted under 35 U.S.C. 154(b) by 0 days.

(21) Appl. No.: 17/850,839

(22) Filed: Jun. 27, 2022

Related U.S. Application Data

(63) Continuation-in-part of application No. 17/584,738, filed on Jan. 26, 2022.

(60) Provisional application No. 63/147,092, filed on Feb. 8, 2021, provisional application No. 63/147,097, filed on Feb. 8, 2021.

(51) Int. Cl.
*F04F 5/10* (2006.01)
*F04F 5/02* (2006.01)
*F04F 5/48* (2006.01)

(52) U.S. Cl.
CPC ..... *F04F 5/10* (2013.01); *F04F 5/02* (2013.01); *F04F 5/48* (2013.01)

(58) Field of Classification Search
CPC ..... F04F 5/02–5/36; F04F 5/48–5/52
USPC ..... 417/76, 188
See application file for complete search history.

(56) References Cited

U.S. PATENT DOCUMENTS 1,159,957 A * 11/1915 Kneass ..... F04F 5/469 417/189
1,988,635 A * 1/1935 Sutton ..... D06F 71/34 417/188
2,399,670 A * 5/1946 Freygang ..... B63C 9/18 417/188
5,624,239 A * 4/1997 Osika ..... F04F 5/20 15/409
6,315,000 B1 11/2001 Goodyear
7,255,136 B2 8/2007 Templet et al.
7,536,864 B2 5/2009 Wolfe et al.
8,083,495 B2 12/2011 Whaling et al.
8,142,169 B2 3/2012 Whaling et al.
9,140,470 B2 9/2015 Verma et al.
9,175,688 B2 11/2015 Neel
(Continued)

FOREIGN PATENT DOCUMENTS

GB 2450565 12/2008

OTHER PUBLICATIONS

"Basic principles of vacuum technology, brief overview," Festo, Jul. 2013, 54 pages [retrieved online Feb. 18, 2022 from: www.festo.com/net/SupportPortal/Files/286804/Basic_Vacuum_Technology_Principles.pdf].

(Continued)

*Primary Examiner* — Bryan M Lettman
(74) *Attorney, Agent, or Firm* — Sheridan Ross P.C.

(57) ABSTRACT

Apparatus, systems and methods for pumping fluids, including for the purpose of controlling temperature and pressure in a propellant tank include a type of novel ejector, consisting of a typical ejector and an isolation valve integrated on the inlet of secondary fluid to an ejector, or suction chamber. The inlet valve is actuated by the application of the primary motive fluid pressure to a motive nozzle. The ejector is configured to operate when submerged in the secondary fluid.

10 Claims, 17 Drawing Sheets

(56) References Cited

U.S. PATENT DOCUMENTS

2015/0152885 A1 6/2015 Dennis

OTHER PUBLICATIONS

Official Action for U.S. Appl. No. 17/584,738, dated Oct. 10, 2023
8 pages Restriction Requirement.

* cited by examiner

EJECTOR WITH INTEGRATED ISOLATION VALVE

CROSS-REFERENCE TO RELATED APPLICATIONS

This application is a continuation-in-part of and claims the benefit of priority from U.S. patent application Ser. No. 17/584,738 filed Jan. 26, 2022 and entitled "Method And Apparatus For Controlling Temperature And Pressure Inside A Propellant Tank," which claims the benefit of priority from U.S. Provisional Patent Application No. 63/147,092 filed Feb. 8, 2021 entitled "Ullage Conditioning System Without Pressurization," and U.S. Provisional Patent Application No. 63/147,097 filed Feb. 8, 2021 entitled "Ullage Conditioning System With Pressurization," the entire disclosures of which are hereby expressly incorporated by reference in their entireties.

FIELD OF THE INVENTION

The present disclosure relates to the field of mechanical engineering and, more particularly, to fluid devices and, more particularly, to ejectors. The present disclosure improves upon the prior art of ejectors to add functionality.

BACKGROUND OF THE INVENTION

Ejectors placed in a process often require an isolation valve upstream of the secondary fluid inlet in order for the process fluid to not leak or pass through the ejector when the ejector is not operating. This isolation valve is normally a separate piece of hardware that has its own actuator and actuation operation.

One common example of this configuration is a line priming operation whereby an ejector is used to suction fluid into an unprimed line before the fluid process can start. Once the line is primed, the ejector will isolate from the process with an isolation valve so that process fluids do not continue to leak out of the system through the non-operating ejector. This system and method is often employed in pump priming. In this example, the pump must be primed with fluid in order to start the pump, but once the pump is running it will generate a syphon and keep itself primed though out operation.

Another example that may require an isolation valve upstream of the ejector's secondary fluid inlet is a vacuum application. Ejectors are used to lower the pressure of a fluid volume to create pressures that are lower than atmospheric pressure. Pressures lower than local atmospheric pressure will be termed vacuum henceforth. In this case, the ejector may be run continuously to maintain the vacuum while a process is being used, e.g. in-space rocket engine testing or thermal vacuum testing, or the ejector may be isolated from the fluid volume once the vacuum is achieved. In the latter case, an operating ejector may negatively affect the process that is carried out under vacuum conditions and as such it must be non-operational and isolated to preserve the vacuum.

In any operation that requires the isolation valve to be closed when the ejector is not in operation, the isolation valve and the ejector may be combined into a single integrated unit.

In another application, the ejector may be used as a pump to move process fluid from the main process to a secondary process. In such an application, the ejector operates in the same manner as in previous examples, and the secondary fluid inlet valve is again used to isolate the ejector from the main process when not in use.

Ejectors may be used to safely fill a propellant tank without venting. On earth, where there is a constant gravitational field, liquid propellant transfer during a tank fill is straight forward since the liquid loads from the bottom up and allows a vent valve at the top of the tank to vent the displaced gas volume, and the boiled off gases in the case of super cold propellants. Super cold propellants are those that change from a liquid phase to a gas phase at temperatures below zero degrees Centigrade or 32 degrees Fahrenheit. Cryogens are an example of a super cold propellant. In most rocket stage tanks, whether in a microgravity environment such as on-orbit, in space, or on the earth's surface generally, propellant in a tank could be in two phases, namely, a liquid phase and a gaseous phase. For purposes of this disclosure, the solid phase is not considered. A super cold liquid propellant transferred into the tank will flash boil as the liquid enters the warmer tank and will result in increased tank pressure that must be controlled. Moreover, in a microgravity environment, the liquid portion of the propellant could be anywhere within the tank which means that venting to control the pressure would likely vent valuable quantities of the precious liquid propellant rather than venting the boil off gas or gaseous phase propellant making the transfer process in space inefficient. Aspects of the present disclosure provide a system and method of controlling the ullage temperature and pressure during microgravity propellant transfer allowing for propellant fill without venting of the tank.

A different issue associated with the use of super cold propellants in space travel is ullage pressure collapse (UPC). In one example, UPC can occur in a microgravity environment when the super cold liquid propellant unsettles and moves about the propellant tank. This phenomenon may occur, for example, when an upper stage is separated from a booster followed by an upper stage or second stage engine start where the upper or second stage accelerates. Conversely, UPC could also be caused by a deceleration. Unsettled super cold liquid propellant may crest and rain through or mix with the ullage causing the ullage to cool significantly. In turn, pressure within the propellant tank drops significantly and, in some cases, uncontrollably. The result can lead to a structural failure of the propellant tank and intermediate bulkhead, or engine malfunction. Higher ullage volumes could exacerbate the issue. Aspects of the present disclosure provide a system and method of controlling the ullage temperature and pressure to eliminate UPC.

Ejectors used for ullage conditioning benefit from being submerged in the liquid of the process or propellant tank, however, this causes the ejector to be flooded when it is not operating. A flooded ejector used for ullage conditioning adversely effects its performance in this task by creating an inconsistent startup transient. The slug of liquid that is ejected from the ejector during this startup can cause an undesired ullage collapse.

These same systems and methods may also be used on the launch pad, on earth, during tank fill operations to condition ullage and prevent catastrophic over pressurization events.

A microgravity environment is a spatial environment in which acceleration is minimal or nearly zero. Such environments are imposed on objects while within earth's gravitational influence when the object is in free fall, or outside of earth's gravitational influence when the object has little to no acceleration.

SUMMARY OF THE INVENTION

Ejectors (also known as jet pumps) are simple devices for controlling the entrainment into and the discharge from a ducted coaxial jet. The suction fluid, or secondary fluid or process fluid, is pumped by means of the momentum of the driving motive fluid jet. A high pressure motive fluid is required to generate the high velocity motive jet. Embodiments according to the present disclosure make additional use of this high pressure motive fluid source by pneumatically actuating and opening a valve at the inlet of the suction chamber simultaneously as it generates the high velocity jet. The valve presented in the preferred embodiment is a poppet valve that is actuated by a normally-closed, pneumatic, spring-return, actuator. Actuator opening pressure must be able to overcome both the spring-return, in addition to the forces imposed on the poppet by the secondary fluid. Any other form of valve maybe utilized, however the pneumatic actuator and its orientation may need to change, for example: a ball valve or a butterfly valve. These quarter-turn valves would require an actuator with a mechanical linkage to convert linear motion to rotational motion that are required. Embodiments of the present disclosure, then, effectively allow the user to actuate both an ejector and an inlet valve with one single control valve that initiates the flow of the motive fluid.

Ejectors according to embodiments of the present disclosure are comprised of at least the following parts: a secondary fluid inlet valve and actuator, a suction chamber, a motive fluid inlet, a motive fluid nozzle, and a mixing tube.

In at least some embodiments, the secondary fluid inlet valve is a normally closed, pneumatically actuated, spring return poppet valve. The actuator receives fluid power from the motive fluid inlet, which is also required by the ejector. The valve poppet isolates the suction chamber from the secondary fluid. Once actuated, the poppet translates to place the suction chamber in fluid communication with the secondary fluid. Once motive fluid pressure is decreased, a spring acting on the actuator piston translates the piston back to its normal position, which consequently translates the valve poppet closed isolating the ejector from the secondary fluid.

The suction chamber is a fluid volume where static pressure is locally reduced to draw in and entrain the secondary fluid. The suction chamber is in fluid communication with the motive fluid nozzle and mixing tube. Once motive fluid is emitted from the motive fluid nozzle at a high velocity it lowers static pressure in the suction chamber which induces flow of the secondary fluid into the suction chamber, through the open valve, and into contact with the high velocity motive fluid.

The motive fluid inlet is a fluid volume that accepts the motive fluid and distributes it to both the motive fluid nozzle and the secondary fluid inlet valve actuator.

The motive fluid nozzle is a nozzle that accelerates the motive fluid to a sufficiently high velocity at its exit to reduce local pressure. The nozzle may be an orifice, a nozzle, or a converging/diverging nozzle.

The mixing tube is in fluid communication with the motive fluid, secondary fluid, and the downstream process. In the mixing tube the sufficiently high velocity motive fluid is in contact with the secondary fluid. At the motive fluid nozzle exit plane, the two fluid streams are coflowing jets that are in contact with one another. The two fluid streams exchange momentum via fluid mixing, which lowers the velocity of the motive fluid, but increases the velocity of the secondary fluid. This momentum exchange effectively mixes these two fluid streams in the mixing tube and ejects the mixture out the end of the mixing tube.

Aspects of the present disclosure provide the ability to refuel cryogenic propulsion stages on-orbit which, in turn facilitates space transportation beyond low earth orbit. The ability to efficiently transfer cryogens between earth-to-orbit tanker vehicles, orbiting propellant depots, and space transportation vehicles is an alternate for earth departure missions rather than developing larger rockets.

Aspects of the present disclosure provide the ability to eliminate UPC by conditioning the temperature and pressure of the ullage and to extract thermal potential energy from the ullage and prevent ullage pressure collapse. The present invention can be utilized to condition the ullage gas on the ground and in flight.

In one embodiment, one or more aerodynamic pumps are associated with a propellant tank. In a preferred embodiment, the aerodynamic pump is a jet pump. A pressurized motive fluid source supplies a condensable motive fluid to an inlet of the aerodynamic pump. The pressure of the motive fluid source must be greater than the pressure in the propellant tank to allow flow. A larger pressure difference is preferred. Liquid propellant within the propellant tank is also in fluid communication with an inlet of the aerodynamic pump. In operation, the condensable motive fluid is accelerated through a nozzle to create a high velocity fluid stream or jet that reduces local static pressure and thereby creates a vacuum. The low static pressure syphons or suctions liquid cryogen out of the liquid space within the propellant tank. The syphoned liquid propellant is entrained or mixed into the flow of the high velocity motive fluid within a mixing tube or chamber. The two fluids mix to form a highly atomized spray of both the liquid cryogen propellant and the motive fluid through momentum transfer between the coflowing fluids. The mixed solution is then exhausted into the ullage space of the propellant tank where evaporation of the atomized spray lowers the ullage gas temperature. The condensable motive fluid is cooled by the mixing with the liquid cryogenic propellant. Because the resulting mixture has a lower temperature than the ullage, the temperature of a localized volume of the ullage is reduced and the total pressure of the ullage is reduced or at least not increased. Continued operation the aerodynamic pump expands the localized volume of reduced temperature ullage and continues to reduce the pressure within the propellant tank. The motive fluid can be pulsed repeatedly until the ullage gas is at the desired conditions or throttled proportionally until the desired operating conditions of the system are attained. Thus, pressure within the propellant tank may be controlled without venting of the propellant tank and without loss of propellant.

According to aspects of this embodiment, the motive fluid may be the same as the propellant, for example liquid hydrogen or some other cryogenic propellant, or it may be some different fluid that does not adversely affect the tanked propellants, for example a fluid that may go into solution with the propellants. The motive fluid source may be external or internal to the propellant tank. The one or more aerodynamic pumps may be located at a perimeter of the propellant tank or at any other location within the propellant tank. The aerodynamic pump or, at a minimum, the mixing chamber of the aerodynamic pump, may be configured to move, oscillate or rotate relative to the interior of the propellant tank to eject the mixture of atomized motive fluid and liquid propellant over a larger localized volume.

The system of this embodiment is operated only by the introduction of the higher pressure motive fluid. No moving parts are required other than a valve to control the motive fluid supply. This system is ideally suited for use in the reduced or microgravity environment of space.

In another embodiment, an atomizer replaces the jet pump. Operation of the system remains similar. A pressurized primary fluid is accelerated, atomized, and ejected into the ullage of the propellant tank. Because the atomized spray has a temperature lower than the ullage, a localized volume of the ullage is cooled and pressure within the propellant tank is reduced. Continued operation the atomizer expands the localized volume of reduced temperature ullage and continues to reduce the pressure within the propellant tank. The fluid entering the atomizer can be pulsed repeatedly until the ullage gas is at the desired conditions or throttled proportionally until the desired operating conditions of the system are attained. Thus, pressure within the propellant tank may be controlled without venting of the propellant tank and without loss of propellant.

According to aspects of this embodiment, the atomized fluid may be the same as the propellant, for example liquid hydrogen or some other cryogenic propellant, or it may be some different fluid that does not adversely affect the tanked propellants, for example a fluid that may go into solution with the propellants. The fluid source may be external or internal to the propellant tank. One or more atomizers may be located at a perimeter of the propellant tank or at any other location within the propellant tank. The atomizer may be configured to move, oscillate or rotate relative to the interior of the propellant tank to spray the atomized fluid over a larger localized volume.

In another embodiment, a mechanical pump may be combined with an atomizer and the added condensable fluid may be unpressurized. One example of an acceptable mechanical pump is a centrifugal pump. Other types of mechanical pumps acceptable for this purpose include pumps of the positive displacement variety. Compared to an aerodynamic pump that has no moving parts, a mechanical pump includes moving parts which introduce possible points for failure not present with an aerodynamic pump. The mechanical pump would pressurize and drive the added primary fluid through an atomizer thereby atomizing the fluid. A localized volume or zone of ullage proximate the point of ejection from the atomizer will undergo a temperature decrease thereby reducing the pressure in the propellant tank. Continued operation the pump expands the localized volume or zone of reduced temperature ullage and continues to reduce the pressure within the propellant tank. The fluid can be pulsed repeatedly until the ullage gas is at the desired conditions or throttled proportionally until the desired operating conditions of the system are attained. Thus, pressure within the propellant tank may be controlled without venting of the propellant tank and without loss of propellant.

According to aspects of this embodiment, the primary fluid may be the same as the propellant, for example liquid hydrogen or some other cryogenic propellant, or it may be some different fluid that does not adversely affect the tanked propellants, for example a fluid that may go into solution with the propellants. The fluid source may be external or internal to the propellant tank. One or more mechanical pumps may be utilized. The pumps may be located external or internal to the propellant tank. The fluid may be introduced at a perimeter of the propellant tank or at any other location within the propellant tank. The pump or, at a minimum, the atomizer, may be configured to move, oscillate, or rotate relative to the interior of the propellant tank to eject the atomized fluid over a larger localized volume.

In a further embodiment, which is a variation of the first embodiment discussed above, an aerodynamic jet pump is combined with an unpressurized source of a condensable motive fluid and a mechanical pump pressurizes the motive fluid prior to the motive fluid entering the jet pump. This embodiment otherwise operates the same as the first embodiment.

In yet a further embodiment, an incondensable or non-condensable motive fluid is used to affect a different result. The pump may be an aerodynamic pump, for example, a jet pump. In the embodiments of FIGS. 1-4 and 7-13, the motive fluid is accelerated through a nozzle to create a high velocity fluid jet that reduces local static pressure and thereby creates a vacuum. The low static pressure suctions liquid cryogen propellant into a mixing tube where the cryogenic liquid propellant is entrained into the flow of the high velocity motive fluid to form a highly atomized spray of both the liquid cryogen and the motive fluid through momentum transfer between the coflowing fluids. The mixed solution is then exhausted into the ullage space of the propellant tank where evaporation of the atomized spray lowers the ullage gas temperature. Additionally, the non-condensable constituent increases the total pressure of the ullage. By reducing or minimizing the thermal potential energy, e.g., the difference in temperature between the ullage gas and the temperature of the liquid cryogenic propellant, the degree by which the ullage pressure can collapse is reduced and minimized, or perhaps eliminated.

Conditioning a propellant tank to avoid ullage collapse may be initiated while the tank is in a gravity environment, i.e., on earth. Conditioning may continue through launch and stage separation. Conditioning may also be initiated at or prior to other acceleration or deceleration events in a micro-gravity environment.

According to aspects of this embodiment, the incondensable motive fluid may not be the same as the propellant and should be some gaseous phase fluid that has a vaporization temperature below that of the propellant in which it is being mixed. For example, in a liquid hydrogen propellant tank, gaseous helium may be used. The incondensable motive fluid source may be external or internal to the propellant tank. The one or more pumps may be located external or internal to the propellant tank. The mixture of incondensable motive fluid and liquid propellant may be introduced at a perimeter of the propellant tank or at any other location within the propellant tank. The pump or, at a minimum, the mixing chamber of the pump, may be configured to move, oscillate or rotate relative to the interior of the propellant tank to eject the mixture of atomized motive fluid and liquid propellant over a larger localized volume.

According to yet another embodiment, one or more aerodynamic or jet pumps may be partially submerged in the liquid propellant. In order to avoid or limit prolonged exposure of the internal components of the jet pump to the liquid propellant, a valve closes the fluid inlet between the jet pump and the liquid propellant. As one example, a pressure actuated poppet valve may be used to restrict or limit the introduction of liquid propellant inside the body of the jet pump when not in use. The poppet valve is linked to a piston that is displaced by the introduction of the pressurized motive fluid into the jet pump. Movement of the piston, in turn, opens the poppet valve, which allows liquid propellant to be drawn or syphoned through the inlet or open valve into the mixing tube or chamber of the jet pump where it is entrained or mixed into the flow of the sufficiently high velocity motive fluid within the mixing tube or chamber. The mixture is then exhausted out of the jet pump and into an area of the propellant tank containing ullage as described above in connection with other embodiments. The poppet valve is biased to a closed position and closes by ceasing the introduction of the pressurized motive fluid.

This embodiment allows the ejector or jet pump to be submerged in a fluid without the suction chamber being flooded while not in operation. One advantage is the elimination of a suction tube communicating liquid to the ejector or, alternatively, the ability to utilize a reduced length suction tube, which can enhance the efficiency of the jet pump. Another advantage of this submerged suction chamber is additional liquid head pressure that is gained by secondary fluid. Added head pressure to the liquid increases the entrainment ratio of the jet pump, where the entrainment ratio is defined as the ratio of the secondary fluid, in this case the liquid, to the motive fluid, which can enhance the efficiency of the jet pump. Reducing or eliminating fluid in the jet pump when not operating also reduces exposure of the components of the jet pump to the liquid. In some scenarios, the liquid may be corrosive and reducing contact between the fluid and the jet pump components prolongs the life of the jet pump. The valve also eliminates or reduces the opportunity for the liquid to enter the supply line for the motive fluid circuit, e.g., back flow through the motive nozzle into the motive fluid supply line. A flooded jet pump may also adversely affect the start up of the jet pump, e.g., liquid hydrogen in the mixing tube would be pushed out as a slug, which could lead to an inconsistent operation, water hammering or other damage to the pump.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about".

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description, the drawing figures, and the exemplary claims set forth herein, taken in conjunction with this Summary of the Invention, define the invention.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and, together with the general description of the invention given above and the detailed description of the drawings given below, serve to explain the principles of the invention.

The drawings are not necessarily to scale and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

Figure 1:
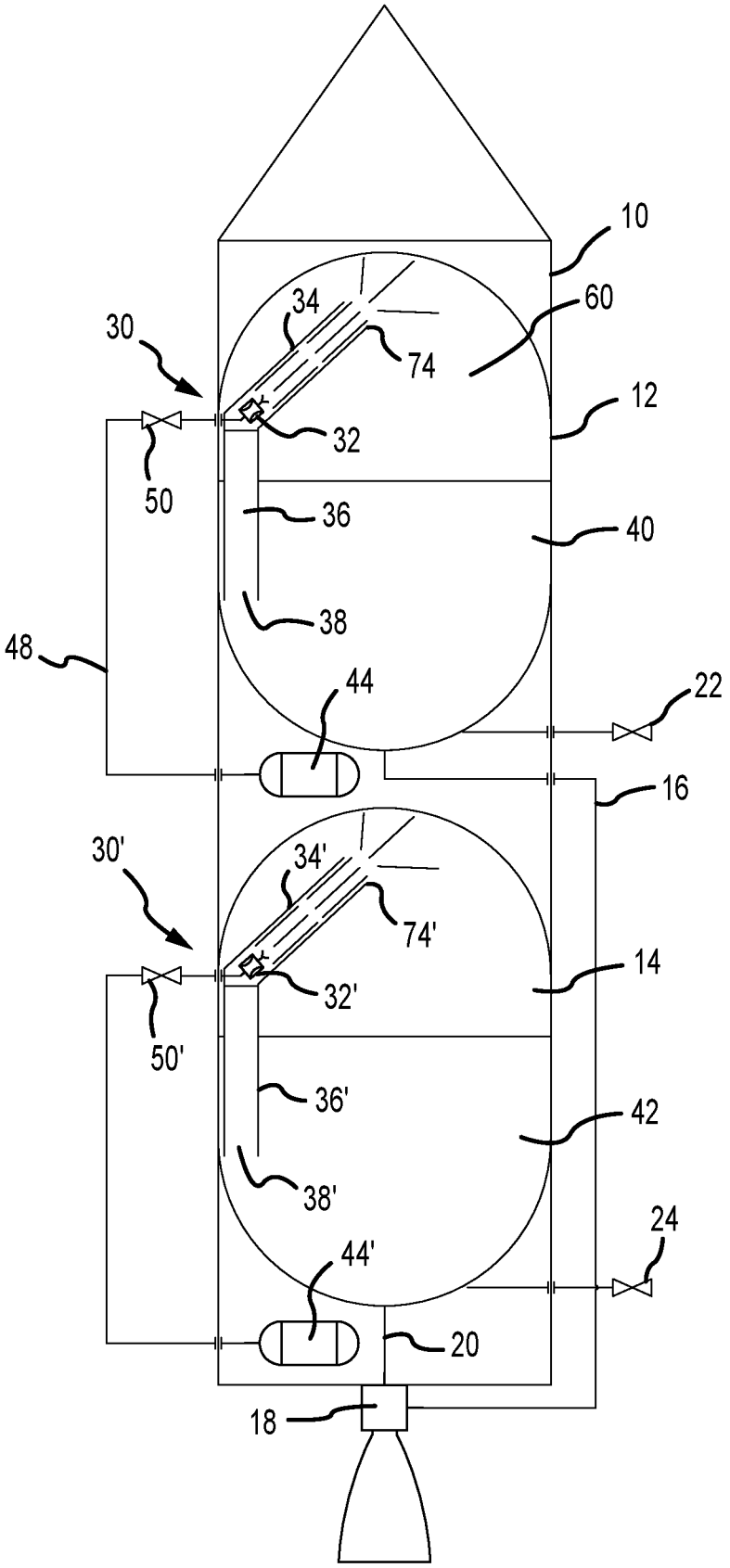
FIG. 1 is a schematic diagram of one embodiment of an upper or second stage of a launch vehicle including a system for controlling ullage temperature and pressure.

FIG. 1 illustrates a first embodiment of a propellant system for a launch vehicle 10. Two propellant tanks 12 and 14 are shown in coaxial alignment. Each tank contains a liquid cryogenic propellant, for example, oxygen 40 in tank 12 or hydrogen 42 in tank 14. A propellant supply line 16 connects the upper tank 12 to the engine 18. A second propellant supply line 20 connects the lower tank 14 to the engine 18. The two propellants are mixed and combusted by the engine 18. A valve 22 may be provided in association with the upper tank 12 to supply propellant to or vent propellant from the upper tank 12. Similarly, a second valve 24 may be provided in association with the lower thank 14 to supply propellant from the tank 14.

Using the upper tank 12 for discussion purposes, FIG. 1 shows an aerodynamic jet pump assembly 30 comprising a motive nozzle 32 disposed in the proximal end of a mixing tube 34, a syphon 36 in fluid communication with the mixing tube 34 and having a distal end 38 disposed in liquid cryogenic propellant 40. A source 44 of pressurized motive fluid 46 is in fluid communication with the motive nozzle 32 by a supply line 48. A valve 50 controls the supply of motive fluid 46 to the motive nozzle 32. The motive fluid 46 is maintained under pressure within the source 44. When the valve 50 is opened, motive fluid 46 will flow to the motive nozzle 32 and when the valve 50 is closed, no motive fluid will be supplied to the motive nozzle 32. The motive fluid 46 may be the same as the propellant, for example, liquid oxygen in the case of tank 12 or some other cryogenic propellant. Alternatively, the motive fluid may be different from the propellant, for example, helium or some other element or composition that would not adversely affect the propellant.

Tank 14 uses a second jet pump assembly 30' that is the same as jet pump assembly 30 associated with tank 12. The same reference numerals, further including a prime (') symbol, are used to designate duplicate components associated with tank 40. Thus, the jet pump assembly 30' includes a motive nozzle 32', a mixing tube 34', and a syphon 36' with a distal end 38'. Here, because propellant tank 14 contains liquid hydrogen, the source 44' associated with tank 14 may contain liquid hydrogen as the motive fluid 46'. A valve 50' controls the flow of pressurized motive fluid 46' in supply line 48' to the tank 14.

Figure 2A:
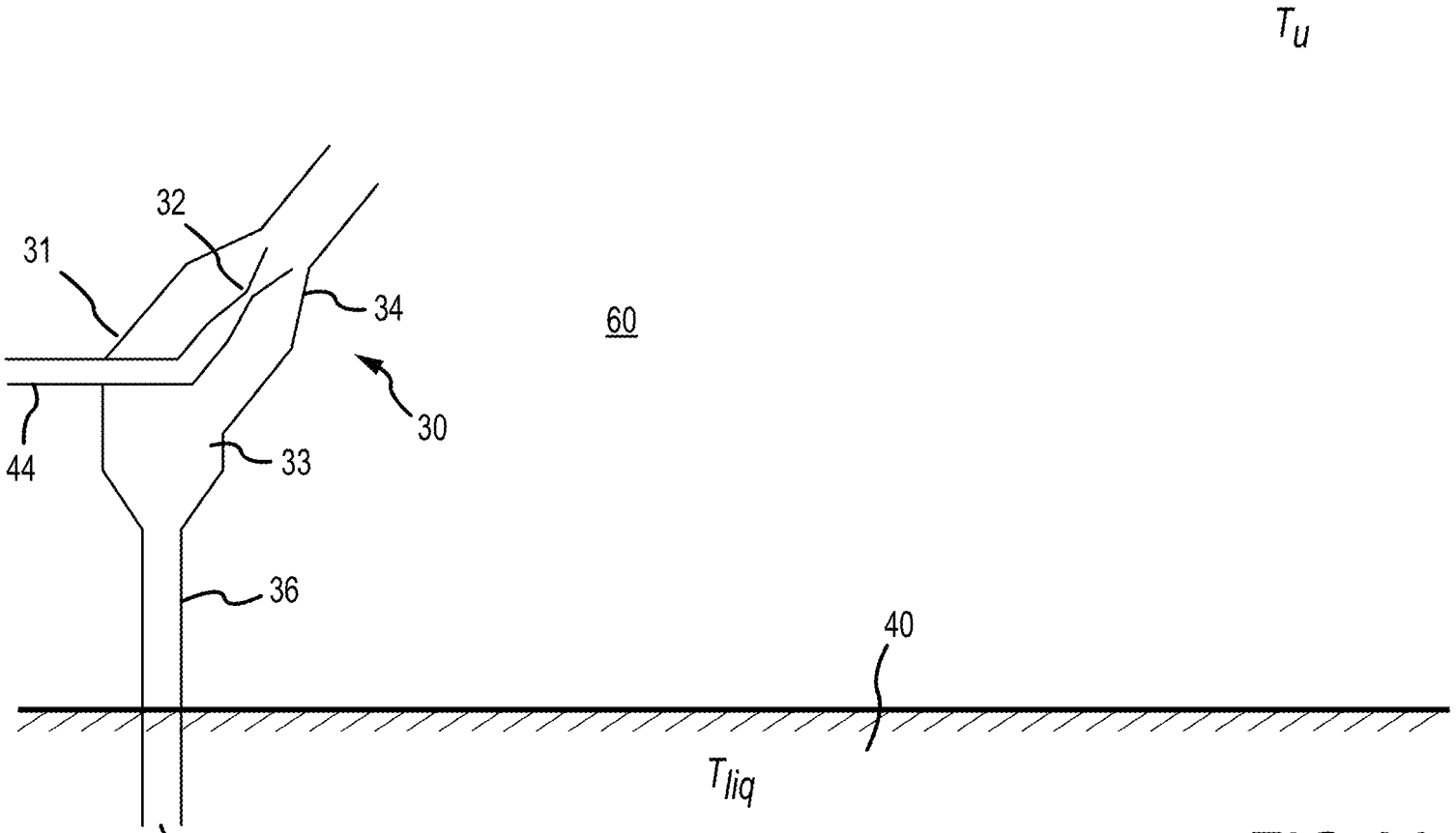
FIG. 2A is a cross-sectional view of one embodiment of a non-operating jet pump assembly inside a propellant tank.

Turning to FIGS. 2A-2E, operation of the jet pump assembly 30 will be described. Jet pump 30' operates in the same way. FIG. 2A illustrates the jet pump assembly 30 in a static or non-operating state. The jet pump assembly 30 includes a jet pump body 31 housing a motive nozzle 32 and defining a suction chamber 33. A mixing chamber or mixing tube 34 and a syphon 36 extend from the ejector body 31. As seen, the distal end 38 of the syphon 36 is positioned within the liquid propellant 40. The motive nozzle 32 and mixing tube 34 are not positioned in the liquid propellant but are positioned in ullage or gaseous propellant 60. It will be appreciated by those of skill in the art that a propellant tank will rarely, if ever, be filled completely with liquid cryogenic propellant. Rather, some portion of the propellant in the tank will be in a gaseous state—also known as ullage. Also, the position of the interface between the liquid and gaseous propellant will change over time and will not always be demarcated by a planer surface as illustrated in the drawings of this disclosure which are provided for illustrative purposes and not intended to depict every possible scenario of liquid and gaseous propellant cohabitating in a single propellant tank. The label Tliq represents the temperature of the liquid cryogenic propellant 40. The label TU represents the temperature of the ullage 60. The temperature of the liquid cryogenic liquid propellant will always be less than that of the ullage 60 (Tliq<TU).

Figure 2B:
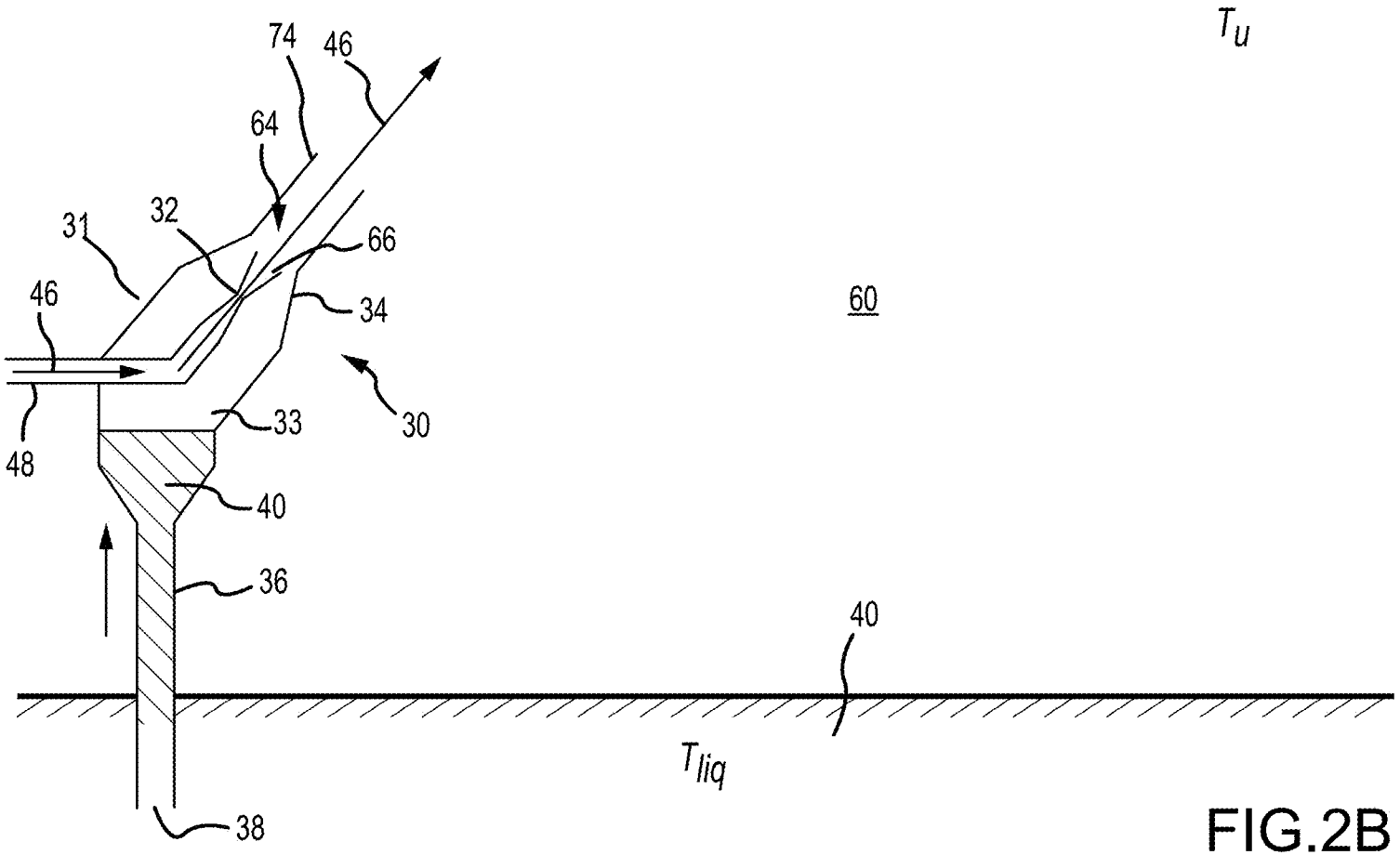
FIG. 2B is a cross-sectional view of the embodiment of FIG. 2A, with the jet pump assembly operating and showing propellant entering a syphon.

In FIG. 2B, valve 50 is open and pressurized motive fluid 46 is flowing from the source 44 to the motive nozzle 32. The condensable motive fluid 46 is accelerated through the nozzle 32 to create a high velocity fluid stream or jet that reduces local static pressure and thereby creates a vacuum. The nozzle 32 may be configured as a subsonic, sonic or supersonic nozzle. Consistent with Bernoulli's principle, an area or zone of low static pressure 64 is created proximate the exit 66 of the motive nozzle 32. An effect of the low-pressure area 64 is that the liquid propellant 40 is drawn through the syphon 36 to a suction chamber 33 and then into the mixing chamber or mixing tube 34 as seen in FIG. 2C.

Figure 2C:
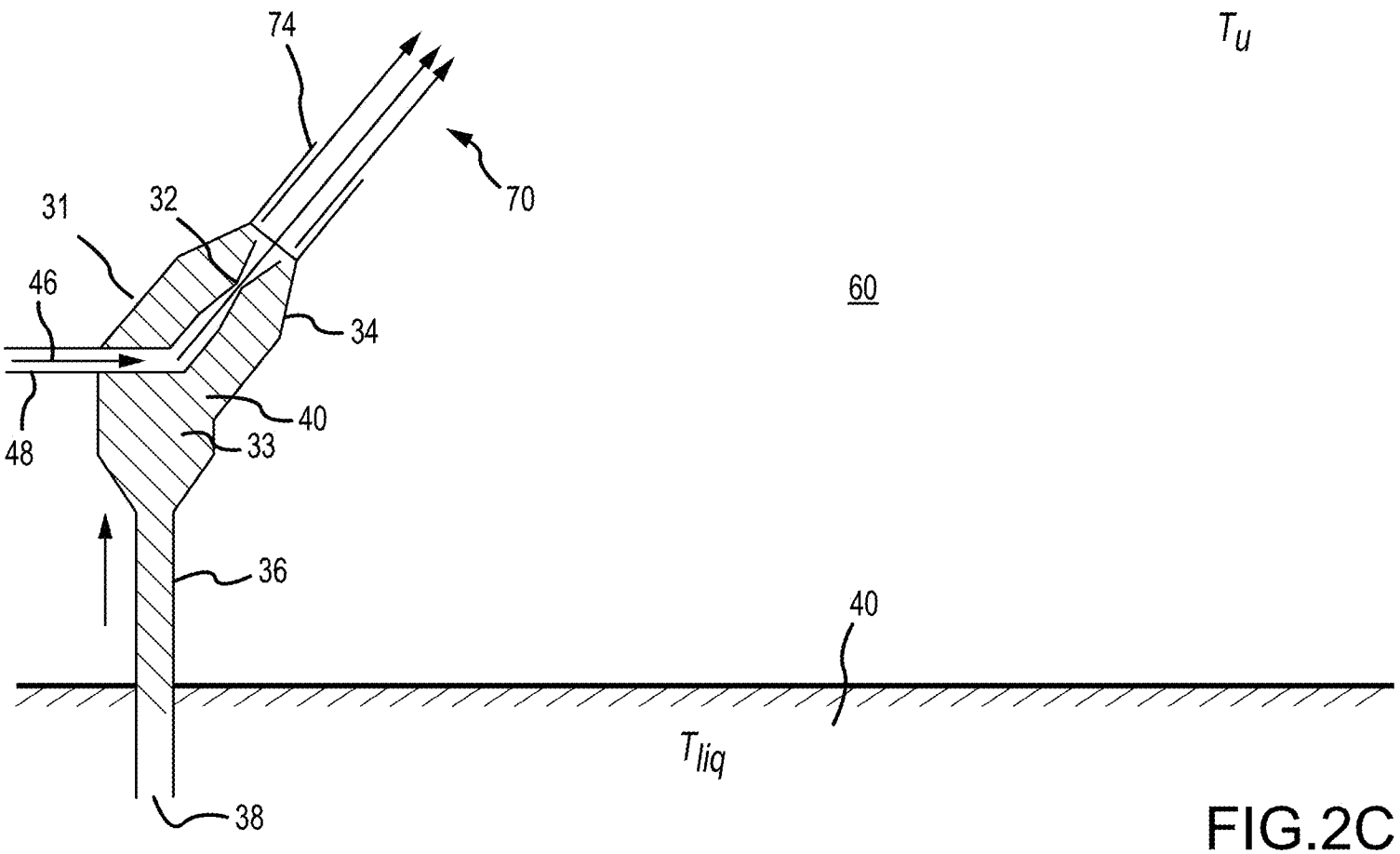
FIG. 2C is a cross-sectional view of the embodiment of FIG. 2A, with the jet pump assembly operating and showing motive fluid and propellant mixing in a mixing tube and exiting the mixing tube into a propellant tank.

FIG. 2C illustrates mixing of the liquid propellant 40 with the motive fluid 46. More particularly, as motive fluid 46 continues to be supplied to the motive nozzle 32, the propellant 40 will be fully drawn into the mixing tube 34 where it will mix with or be entrained into the high velocity motive fluid 46 exiting the motive nozzle 32. The two fluids mix to form a highly atomized spray or mixture 70 of both the liquid cryogen propellant 40 and the motive fluid 46 through momentum transfer between the coflowing fluids.

Figure 2D:
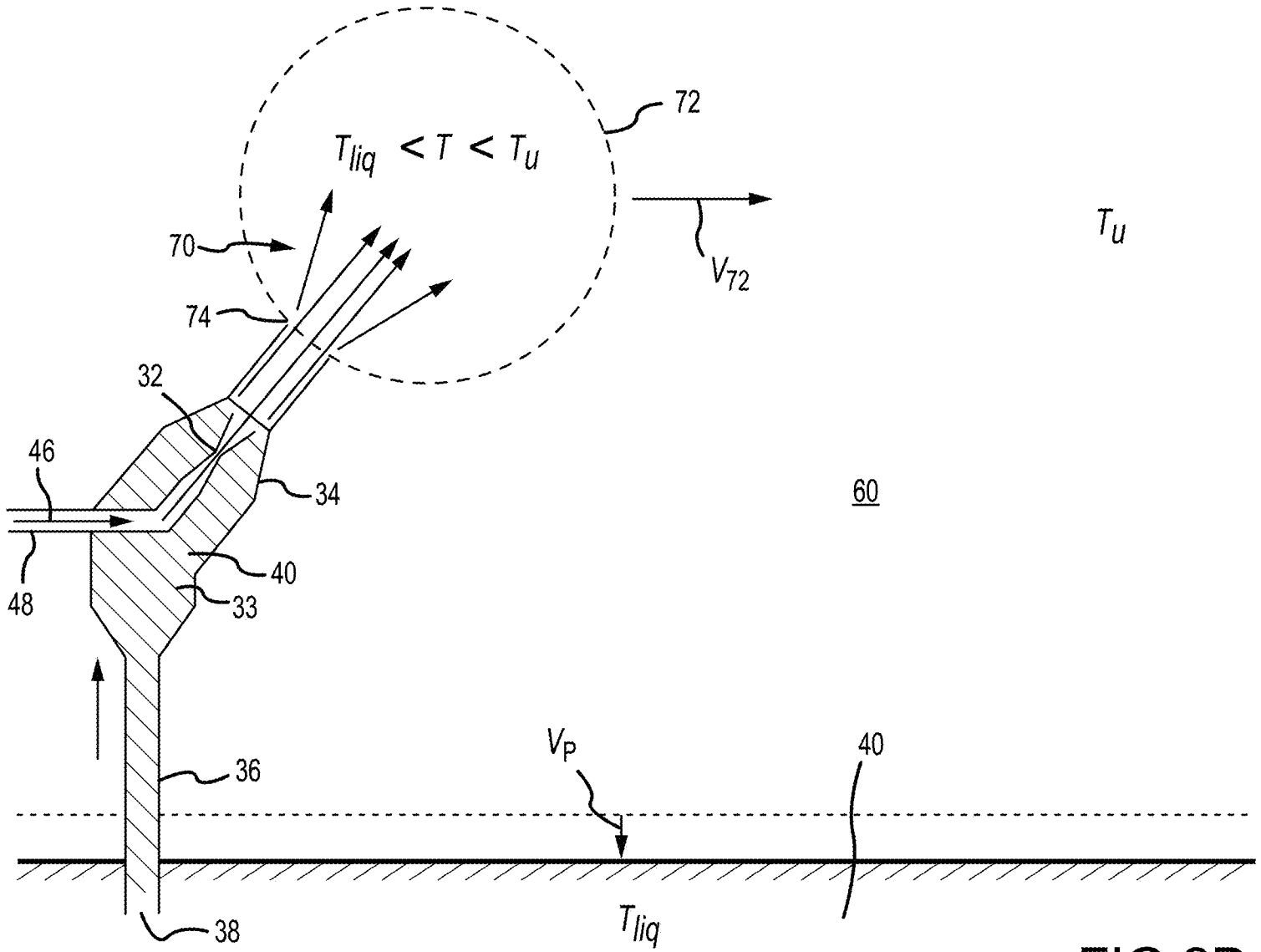
FIG. 2D is a cross-sectional view of the embodiment of FIG. 2A, with the jet pump assembly operating and showing a volume of ullage at a temperature lower than the temperature of the ullage generally.
Figure 2E:
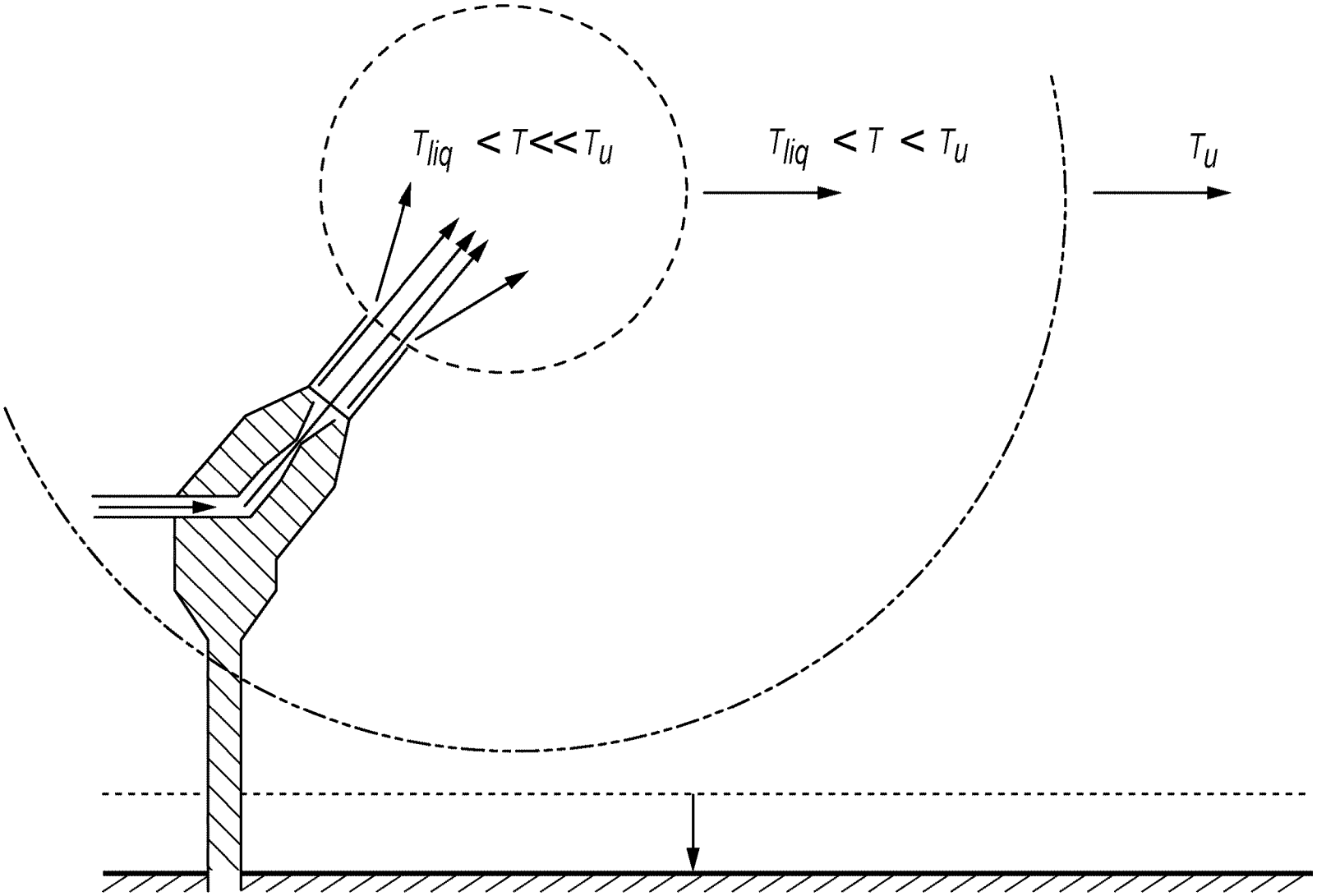
FIG. 2E is a cross-sectional view of the embodiment of FIG. 2A showing the effect of continuing operation of the jet pump assembly.

FIG. 2D illustrates the creation of an area 72 of reduced temperature within the ullage 60 proximate the exit 74 of the mixing tube. More particularly, the condensable motive fluid 46 is cooled by the mixing with the liquid cryogenic propellant 40. As a result, the temperature T of the area 72 is less than the temperature TU of the ullage 60 and greater that the temperature Tliq of the propellant 40 (Tliq<T<=TU). Because evaporation is occurring, if the process continues the temperature of the area 72 and the temperature of the ullage (TU) could reach an equilibrium and approach or reach the temperature of the liquid propellant (TU). Vaporization of the liquid droplets in the mixture efficiently cools the ullage. Because the resulting mixture of the motive fluid 46 and the liquid propellant 40 has a lower temperature than the ullage 60, the temperature of a localized volume 72 of the ullage is reduced and the total pressure of the ullage 60 is reduced or at least not increased. The arrow VP illustrates that the volume of the liquid propellant 40 diminishes as the result of syphoning liquid propellant 40 to mix with the motive fluid 32. The arrow V72 illustrates that the volume of the localized area 72 increases based upon the duration of the operation of the jet pump assembly 30. Indeed, as the jet pump assembly continues to operate, the volume of area 72 will increase as generally illustrated in FIG. 2E expanding the volume V72 of reduced temperature ullage and further reducing the pressure within the propellant tank.

The present invention is superior to a detachable ground-only conditioning system for several reasons, including: 1) it has the unique capability to condition the ullage in flight to reduce the effects of aero heating and ambient helium pressurization, 2) it is more cost effective, 3) it is less complicated, 4) there are no additional moving parts, and 5) the ambient helium and the ullage gas are cooled.

Figure 3:
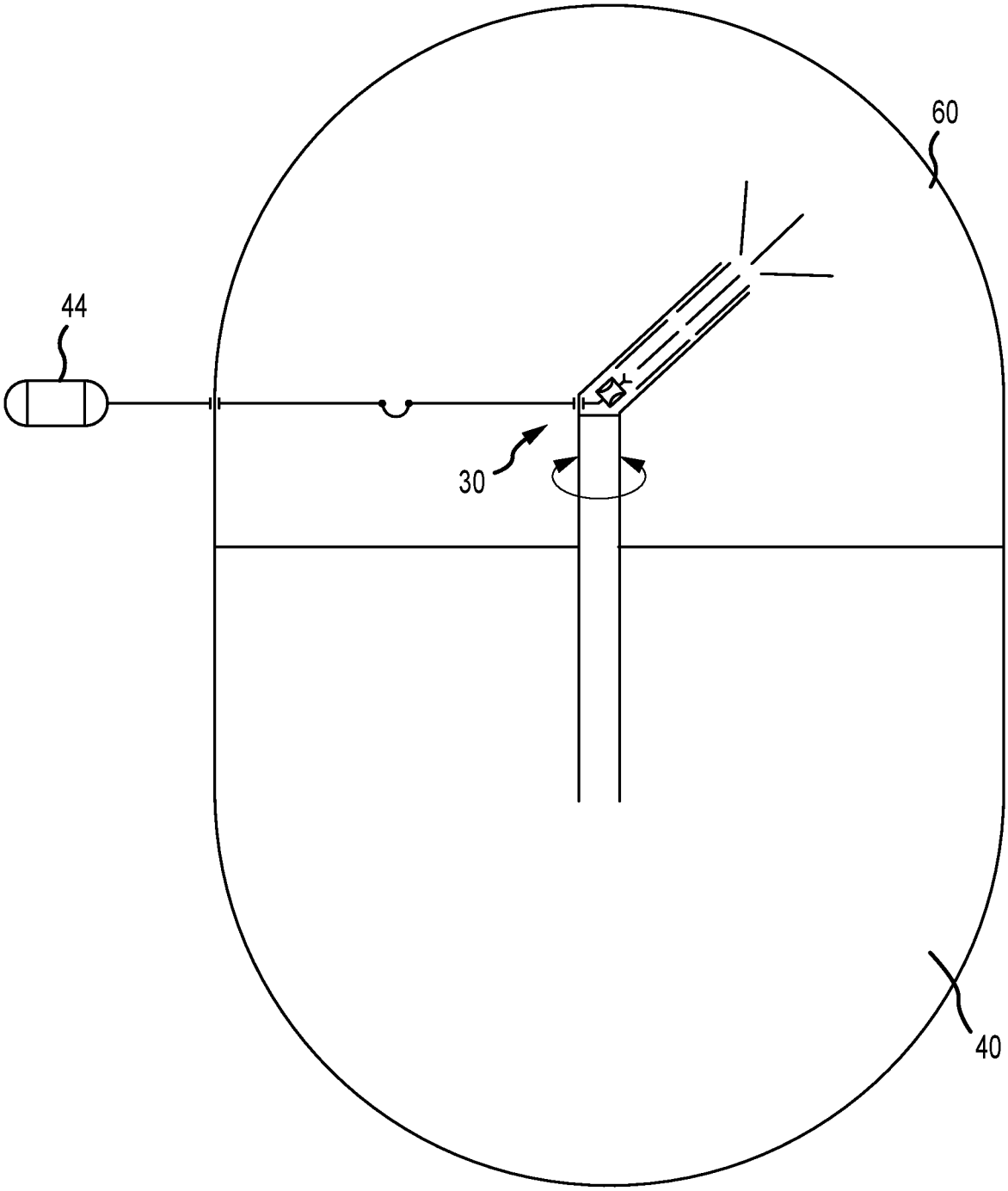
FIG. 3 is a schematic diagram of a propellant tank containing an alternative embodiment of a jet pump assembly.
Figure 4:
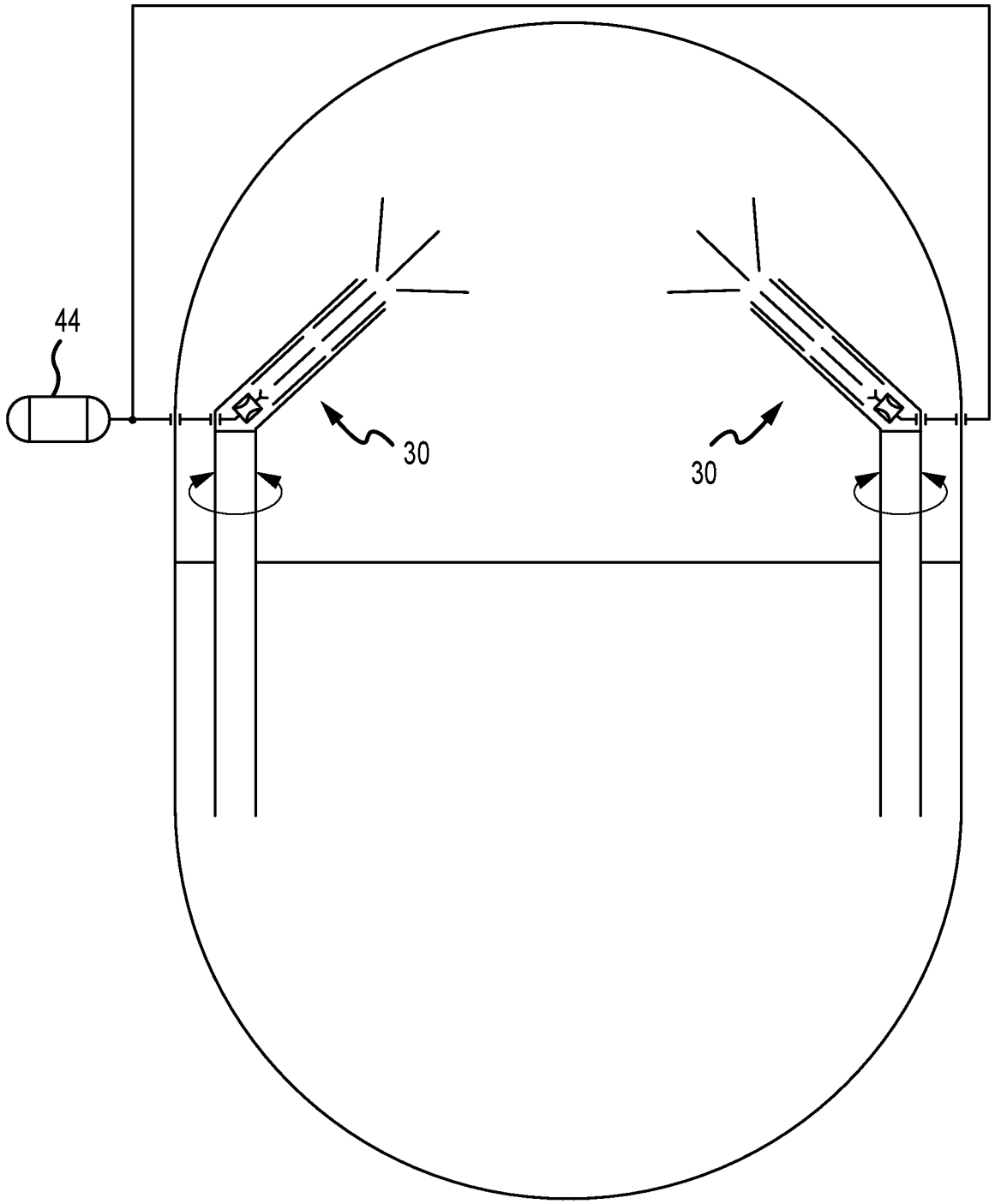
FIG. 4 is a schematic diagram of a propellant tank containing multiple jet pump assemblies.

By using forced convective vaporization as explained above, a propellant tank may be filled with cryogenic liquid propellant without a need to vent the tank during the fill operation. The operation introduces a motive fluid in the form of a condensable, pressurized and atomized cryogenic liquid propellant into the tank ullage to decrease the ullage gas temperature in a controlled manner. In the specific example of FIG. 1, the vehicle 10 includes two propellant tanks 12 and 14, each with a different cryogenic propellant. Cryogenic liquid oxygen may be in one tank and cryogenic liquid hydrogen in the other. In this context, where the motive fluid is condensable, cryogenic liquid oxygen may be the motive fluid for the oxygen tank 12 and cryogenic liquid hydrogen may be the motive fluid for the hydrogen tank. In this scenario, cryogenic liquid oxygen should not be added to the tank containing cryogenic liquid hydrogen. In other scenarios, it may be acceptable to utilize a single common condensable motive fluid for each propellant tank 12 and 14. The motive fluid need not be continuously supplied to the motive nozzle but may be pulsed repeatedly, intermittently stopped and started or the nozzle 50 and 50' may be throttled proportionally to regulate the cooling in the tank and control pressure. In FIGS. 1 and 2A-2E, the jet pump assembly 30 is shown at a position adjacent a perimeter wall of the tank. As illustrated in FIGS. 3 and 4, the jet pump assembly 30 may be positioned in the center of the tank or at another location based upon other factors. The assembly may also be configured to rotate or oscillate to disperse the atomized mixture over a larger volume. In alternative embodiments, multiple jet pump assemblies may be included in a single tank. In addition, the source 44 of the motive fluid 46 is show outside of the tank 12. In a non-limiting alternative embodiment, the source 30 may be positioned inside the tank 12. Further still, FIG. 1 shows a separate source 44 and 44' for each tank 12 and 14, respectively. A single source tank may supply motive fluid to both tanks 12 and 14 in appropriate circumstances and under appropriate conditions as would be understood by those of skill in the art upon review of the present disclosure.

Figure 5:
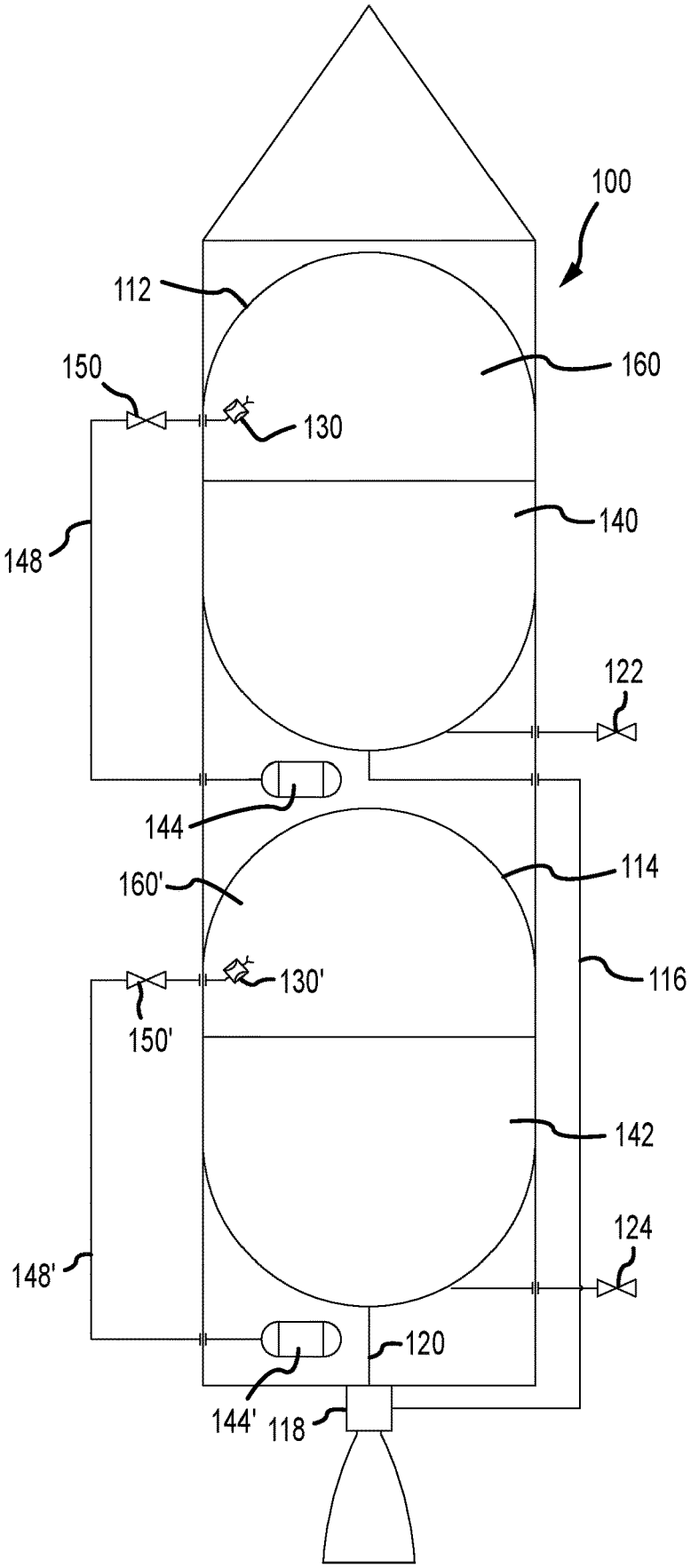
FIG. 5 is a schematic diagram of an alternative embodiment of an upper or second stage of a launch vehicle including a system for controlling ullage temperature and pressure.

FIG. 5 illustrates another embodiment of a system for controlling propellant tank temperature and pressure for use in filling propellant tanks with cryogenic liquid propellant without the need to vent the tank. An upper or second stage 100 of a launch vehicle is shown. The vehicle contains a first propellant tank 112 for holding a first cryogenic liquid propellant 140 and a second propellant tank 114 for holding a second cryogenic liquid propellant 142. A propellant supply line 116 connects the upper tank 112 to the engine 118. A second propellant supply line 120 connects the lower tank 114 to the engine 118. The two propellants are mixed and combusted by the engine 118. A valve 122 may be provided in association with the upper tank 112 to supply propellant to or vent propellant from the upper tank 112. Similarly, a second valve 124 may be provided in association with the lower thank 14 to supply propellant or vent propellant from the tank 114.

The upper tank 112 further includes an atomizer 130 connected to a source 144 of a pressurized, motive fluid 146 that is supplied to the atomizer 130 by a supply line 148. A valve 150 controls the flow of motive fluid 146 to the atomizer 130. The lower or second tank 114 includes the same components. An atomizer 130' is connected to a source 144' of a pressurized, motive fluid 146' that is supplied to the atomizer 130' by a supply line 148'. Nozzle 150' controls the flow of the motive fluid 146' to the atomizer 130'.

Figure 6:
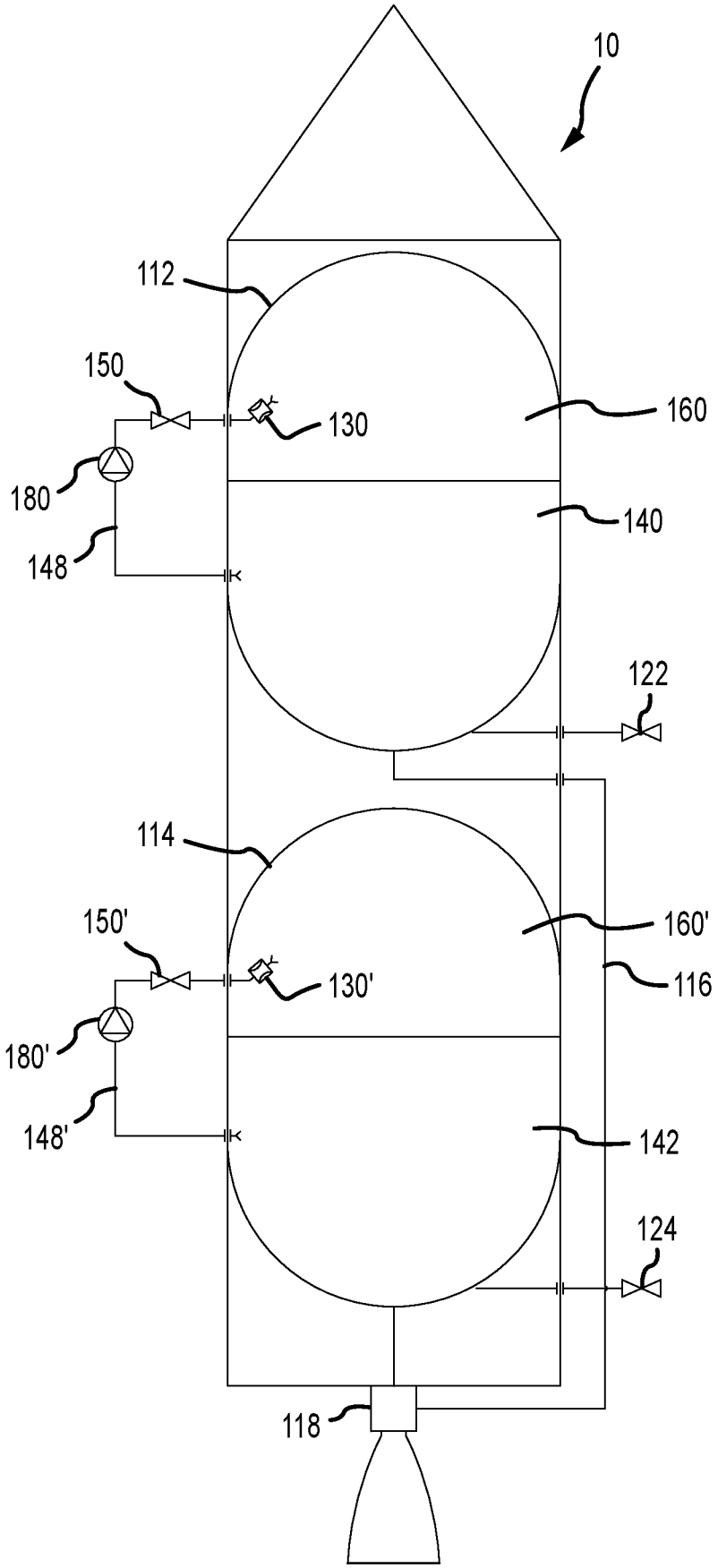
FIG. 6 is a schematic diagram of a further alternative embodiment of an upper or second stage of a launch vehicle including a system for controlling ullage temperature and pressure.

The embodiment of FIG. 6 illustrates a further alternative. Here, the motive fluid is the cryogenic liquid propellant in each of the tanks 112 and 114. A pump 180 is provided in association with the first tank 112 and a pump 180' is provided in association with the second tank 114 to withdraw the propellant from the tank and forward it to the atomizers 130 and 130'. In one non-limiting example, the pumps 180 and 180' are centrifugal pumps. Alternative pumps could be of the positive displacement variety.

The embodiments illustrated in FIGS. 5 and 6 may also be used to control ullage temperature and pressure within a propellant tank containing cryogenic liquid propellant. In operation, a condensable motive fluid under pressure is supplied to the atomizer 130 and 130' which atomizes the motive fluid and disperses it into the ullage of a propellant tank containing a liquid cryogenic propellant. Similar to the embodiments that utilize a jet pump assembly, the atomized spray has a temperature less than that of the ullage. In one non-limiting example regarding the embodiment of FIG. 5, the motive fluid 146 and 146' is the same liquid propellant as contained in the propellant tank. In other non-limiting examples involving the embodiment of FIG. 5, the motive fluid may be cryogenic liquid helium or nitrogen. The atomized spray creates a volume or localized area having a temperature less than that of the ullage generally, which reduces pressure within the tank. Continuing to supply the motive fluid to the atomizer further reduces the temperature of the ullage and further controls pressure within the tank.

In the embodiments of FIGS. 5 and 6, the motive fluid 146 and 146' need not be continuously supplied to the atomizer 130 and 130' but may be pulsed repeatedly, intermittently stopped and started or the nozzle 150 and 150' may be throttled proportionally to regulate the cooling in the tank and control pressure. In FIGS. 5 and 6, the atomizers 130 and 130' are shown at a position adjacent a perimeter wall of the tank. Similar to the jet pump assembly embodiments illustrated in FIGS. 4 and 5, the atomizers 130 and 130' may be positioned in the center of the tank or at another location based upon relevant factors. The atomizer may also be configured to rotate or oscillate to disperse the atomized mixture over a larger volume. In alternative embodiments, multiple atomizers may be included in a single tank. In addition, the source 144 and 144' of the motive fluid 146 and 146' are shown outside of the tank 12. In a non-limiting alternative embodiment, the source 144 and 144' may be positioned inside the tank 112 and 114. Further still, FIG. 5 shows a separate source 144 and 144' for each tank 112 and 114, respectively. A single source tank may supply motive fluid to both tanks 112 and 114 under appropriate circumstances and under appropriate conditions as would be understood by those of skill in the art upon review of the present disclosure.

Figure 7:
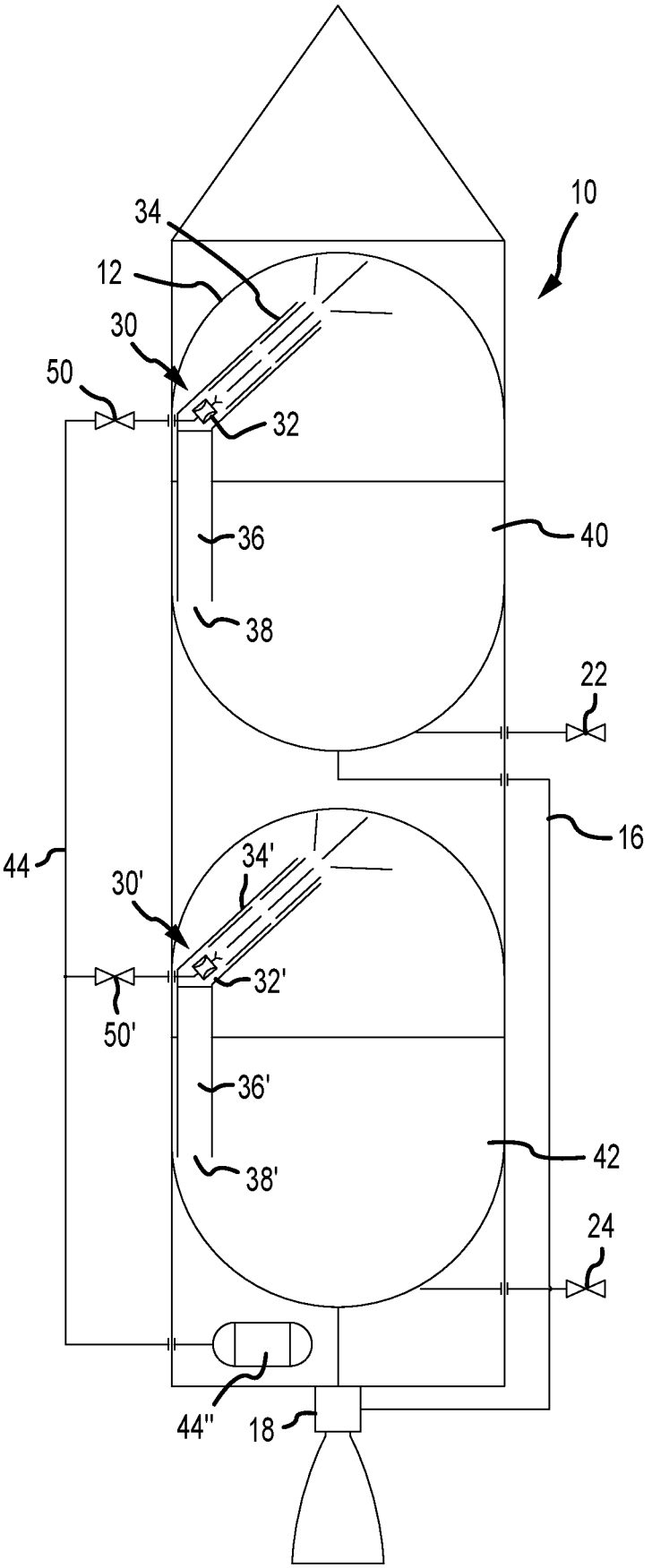
FIG. 7 is a schematic diagram of another alternative embodiment of an upper or second stage of a launch vehicle including a system for controlling ullage temperature and pressure.

The embodiment illustrated in FIG. 7 is an alternative to the embodiments of FIGS. 1 and 3-5. Here, a single motive fluid source 44" provides pressurized, incondensable motive fluid to the jet pump assemblies 30 and 30'. Because there are two different cryogenic propellants involved, the motive fluid should not be one of the propellants but rather a fluid that is incondensable in both propellants like helium. As with all of the embodiments disclosed herein, the propellant tanks may be conditioned separately or simultaneously.

Figure 8:
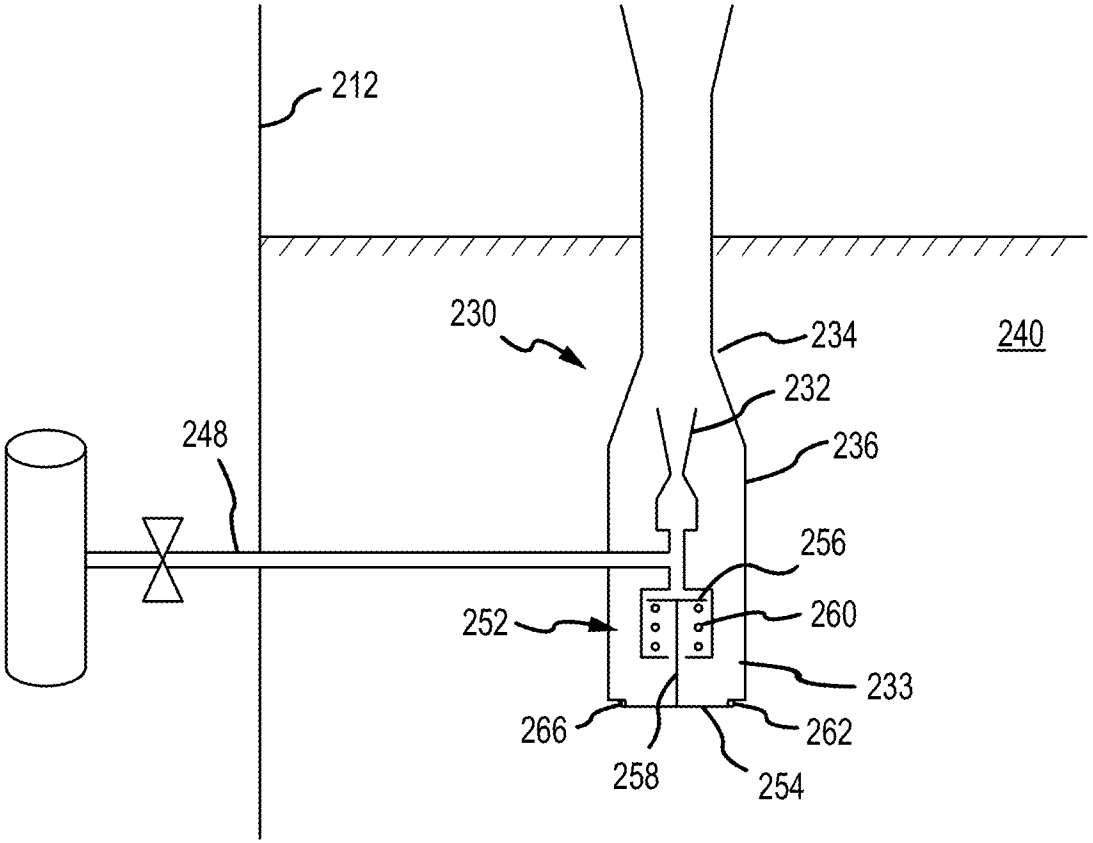
FIG. 8 is a schematic diagram of a further alternative embodiment of jet pump partially submerged in a liquid and including an inlet valve to control liquid flow to the jet pump.

There may be circumstances in which it is desirable to submerge or partially submerge the body of a jet pump within a liquid, i.e., within a liquid propellant in a tank or container containing liquid and gaseous propellant. One example is illustrated in FIG. 8 where the body 236 of an ejector or jet pump 230 is partially submerged in liquid propellant 240 within a propellant tank 212. As also seen, a supply line 248 supplies motive fluid, under pressure, to a nozzle 232 positioned inside the body 236 of the ejector or jet pump 230. In such a scenario, it also may be desirable to control or limit when the liquid 240 is allowed into the interior of the jet pump 230. Allowing the liquid to remain continuously inside the jet pump could cause or accelerate damage to the jet pump. For example, the liquid 240 may comprise a strong acid or a strong base that can harm special coatings on the internal components of the pump 230. Prolonged exposure to liquid hydrogen can lead to hydrogen embrittlement in the internal metal components. In addition, an on-going presence of the liquid 240 inside the jet pump could cause the liquid to infiltrate the motive fluid supply line 248 and motive fluid source, which could lead to contaminating the motive fluid affecting the properties of the motive fluid causing blockages and icing of the motive supply line and the motive fluid source container may not be rated for the cold temperatures of the liquid 240 also causing damage to this hardware. Chemical reactions between the motive fluid and liquid may also cause unintended pressure increases. Additionally, the presence of a liquid slug in the mixing tube 34, above the motive nozzle 232, prior to jet pump operation could expel an unmixed liquid slug into the ullage that would lead to a start-up transient of the jet pump that may excessively cool the ullage or otherwise lead to inconsistent behavior.

Figure 9:
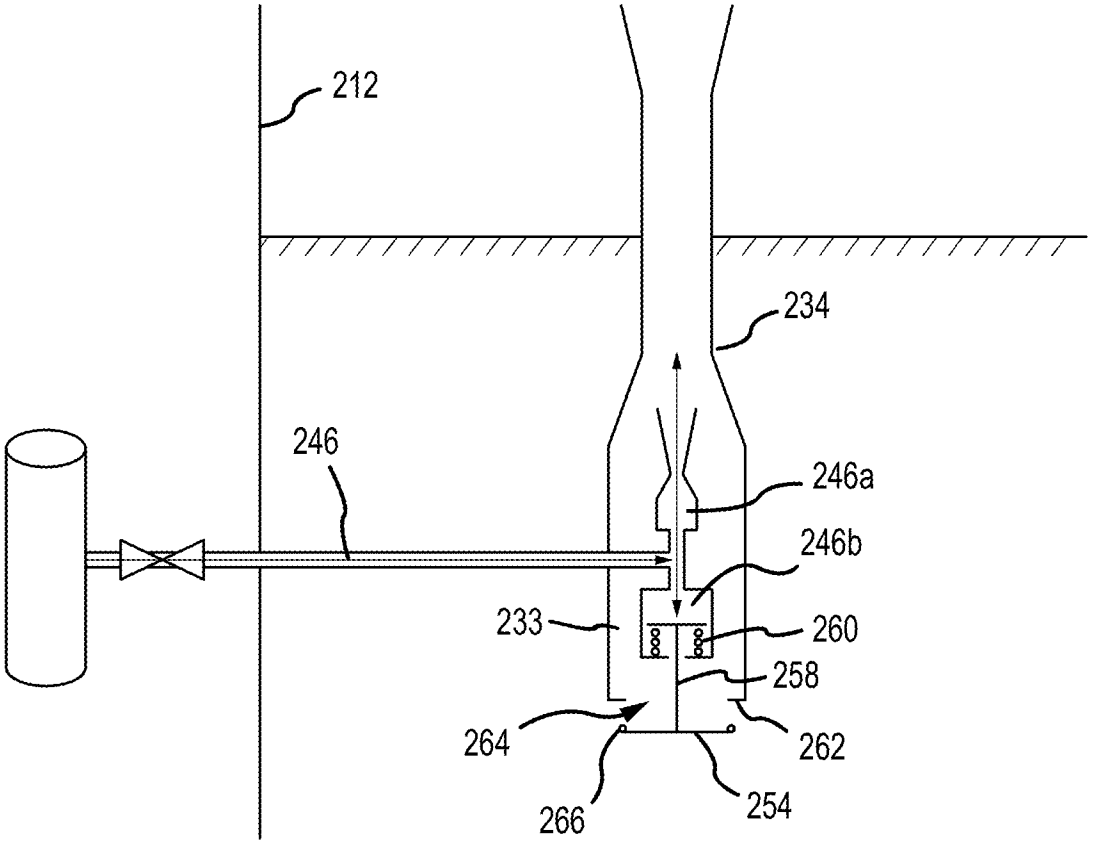
FIG. 9 is the embodiment of FIG. 8, showing an inlet valve in an open position and the introduction of a motive fluid.
Figure 10:
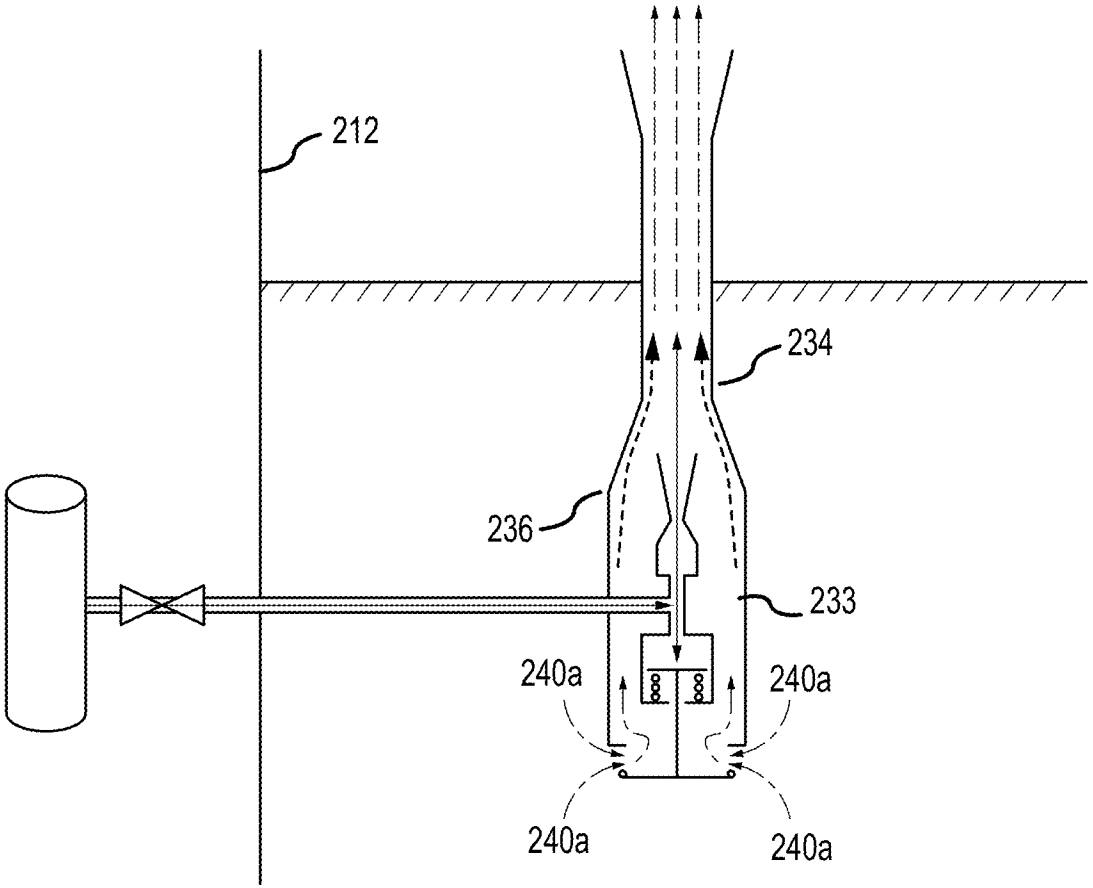
FIG. 10 is the schematic view of FIG. 9, further showing liquid being drawn in to the jet pump and a mixture of liquid and motive fluid exhausted from the jet pump.
Figure 11:
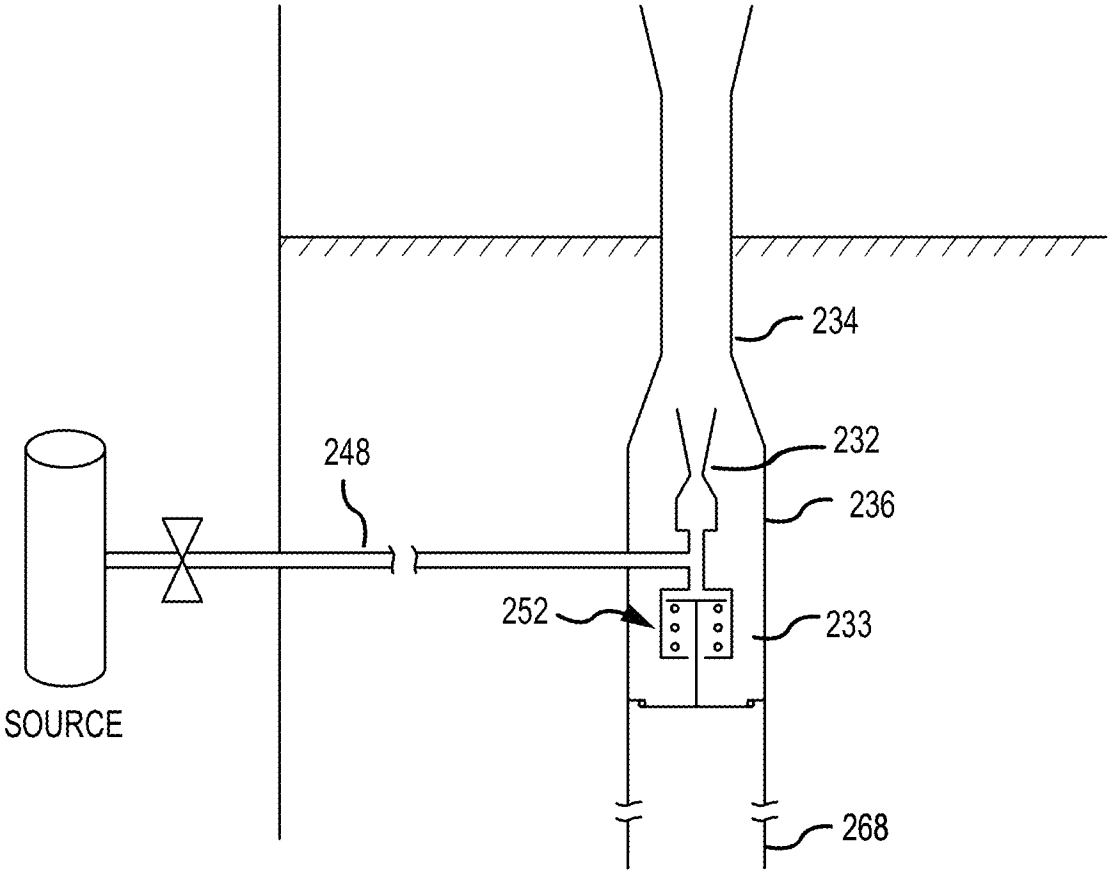
FIG. 11 is a schematic diagram of an alternative embodiment of the jet pump of FIG. 8 (add syphon tube extension).

Accordingly, in this embodiment, the jet pump 230 is provided with an inlet valve 250 to control the ingress of liquid 240 into the interior of the jet pump. As illustrated in FIG. 8 the inlet valve 250 includes an isolation valve 252 that has a closed state (FIG. 8) and an open state (seen in FIG. 9). The isolation valve 252 included a valve body 254 connected to a piston 256 by a valve stem 258. Motive fluid 246 is introduced into the jet pump 230 via supply line 248. Turning to FIG. 9, the pressure of the motive fluid 246 forces a portion of the motive fluid **246*a* to travel through the nozzle 232 to create a high velocity fluid stream or jet that reduces local static pressure and thereby creates a vacuum as discussed herein in connection with other embodiments. A second portion of the pressurized motive fluid 246*b* displaces piston 256 downwardly or outwardly in the context of FIG. 9. The piston 256 is biased to the closed position illustrated in FIG. 8 by spring 260. Therefore, the force of the motive fluid 246*b* must be sufficient to overcome the force of the spring 260. When in the closed position illustrated in FIG. 8, the valve body 254 is positioned in a seat 262 formed at the liquid inlet 264 of the pump 230. A gasket or similar seal 266 may be provided on the valve body 254 or around the inlet 264 to facilitate creating a liquid seal when the valve body 254 is closed. Upon the motive fluid 246*b* displacing the piston 256, the rod or stem 258 displaces the valve body 254 to open the inlet 264. Simultaneously, as a result of the low-pressure zone generated by the motive fluid 246*a* passing through the nozzle 232, liquid propellant 240*a* is syphoned or drawn into the suction chamber 233 and then to the mixing chamber 234 as illustrated in FIG. 10. As long as the motive fluid 246 is delivered at or above a threshold pressure needed to displace the piston 256, the valve body 254 will remain open. Ceasing the supply of the motive fluid 246 will cause the valve body 254 to close as illustrated in FIG. 8. It should be appreciated that the liquid inlet 264 of the isolation valve 252 may be in direct communication with a liquid 240, as illustrated in FIGS. 8-10 where the ejector body 236 is submerged in the liquid 240 or, alternatively, as illustrated in FIG. 11, a suction or syphon tube 268 may extend from the valve 252 to allow the jet pump 230** to draw liquid from a farther distance.

Figure 12:
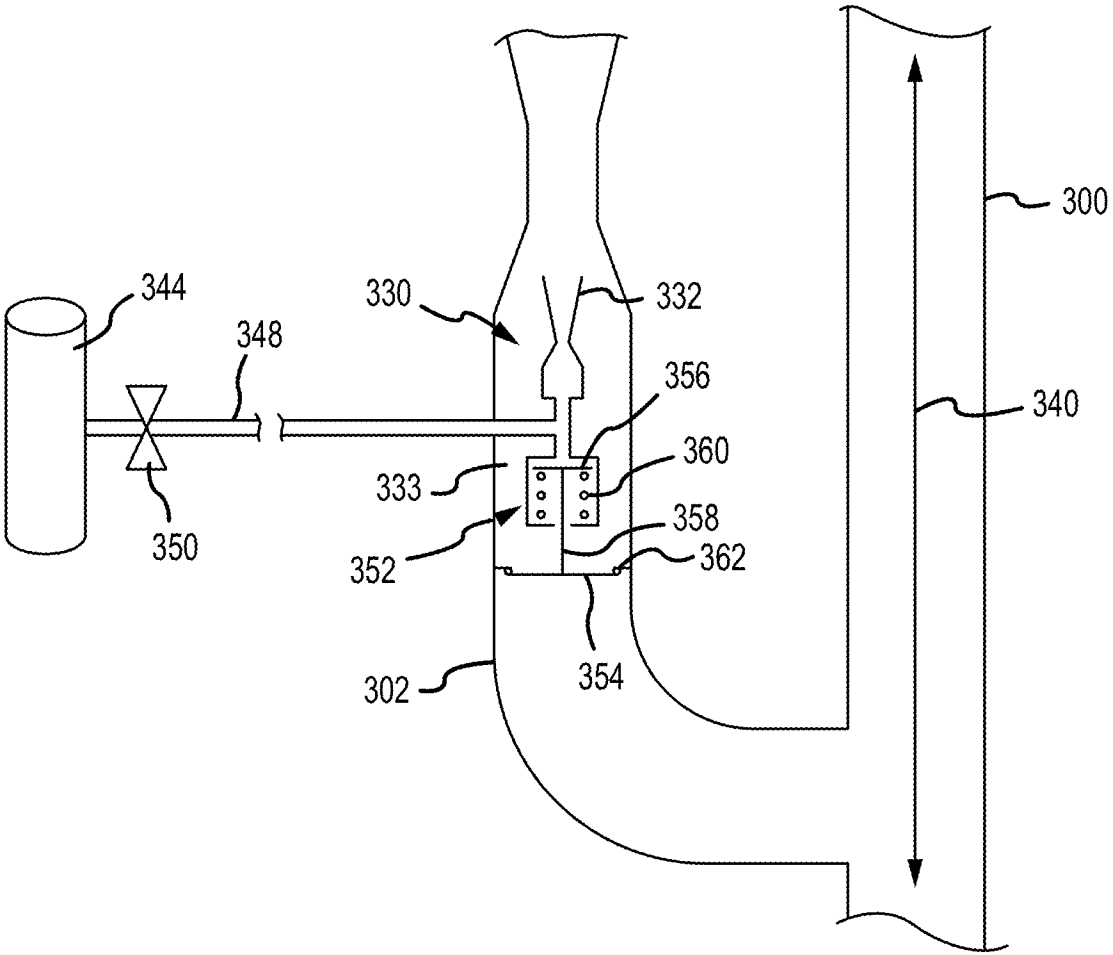
FIG. 12 is a schematic diagram of a further alternative embodiment of a jet pump.
Figure 13:
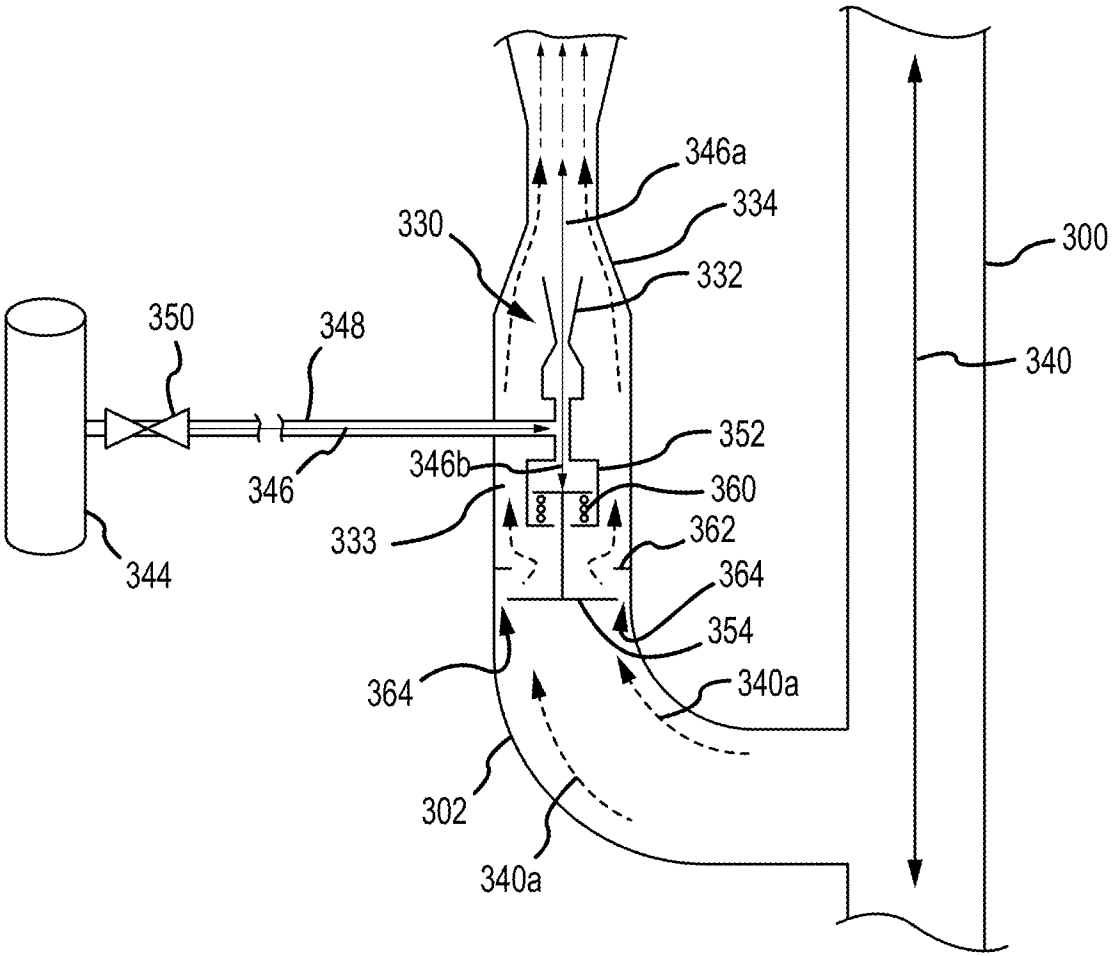
FIG. 13 is a schematic of the embodiment of FIG. 12, with the valve open.

FIGS. 12 and 13 show an embodiment according to the present disclosure in service on process piping. Here, the jet pump is used to suction fluid from main process piping. Non-limiting examples include suctioning fluid into an unprimed line before a primary fluid process commences, generating a vacuum in association with a primary process, e.g., in-space rocket engine testing or thermal vacuum testing, moving fluid from a primary process to a secondary process, or in any operation that requires the isolation valve to be closed when the ejector is not in operation. Turning to the FIGS. 12 and 13, a primary fluid line or pipe 300 and a secondary line or pipe 302 are shown. A jet pump 330 is positioned in the secondary line 302 which is in fluid communication with the primary line 300. When valve 350 is opened, motive fluid 346 under pressure from motive fluid source 344 is released into motive fluid supply line 348. The motive fluid 346 splits with a first portion **346*a* entering the jet pump 330 and a second portion 346*b* engaging a piston 356 that is part of isolation valve 352. The force of the motive fluid portion 346*b* overcomes the counter force of spring 360 and the piston is moved downwardly as illustrated in FIG. 13. Downward movement of piston 356 cause valve stem 358 to open the valve body 354. The valve body 354 rests in or on a valve seat 362 when closed. A gasket or seal 366 may be provided on the valve body 354 or around the seat 362. As a result of a low pressure area created by motive fluid 346*a* exiting nozzle 332, primary fluid 340*a* is drawn through the opening 364 of the isolation valve 352 and into a suction chamber 333 and then into the mixing chamber 334 of the jet pump 330 where it mixes with motive fluid 346*a*. The motive fluid pressure opens the secondary fluid inlet valve 354 and subsequently draws in the process fluid 340*a* from the process or primary pipe 300, pumps this fluid out of the process pipe 300 to secondary process(es), or simply reduces the pressure in the main process piping 300 to prime the line, create vacuum, or to evacuate the line to bring the process into or out of service. Once the ejector 330 has completed its operation, the motive fluid pressure supply is isolated and the secondary fluid inlet valve 354 is closed, effectively isolating the jet pump 330** and its downstream process from the main process.

At least some of the embodiments illustrated and discussed herein may be used for purposes other than filling a propellant tank with a liquid cryogenic propellant without needing to vent the tank. In particular, embodiments illustrated and described may be used to reduce or eliminate the occurrence of ullage collapse. In the embodiments illustrated in FIGS. 1-4 and 7-13, an incondensable or non-condensable fluid may be used in place of the condensable motive fluid. The incondensable motive fluid is accelerated through a nozzle to create a high velocity fluid jet that reduces local static pressure and thereby creates a vacuum. The low static pressure suctions liquid cryogen out of the liquid space within the propellant tank where it is entrained into the flow of the high velocity motive fluid, preferably within a mixing chamber or tube, to form a highly atomized spray of both the liquid cryogen and the motive fluid through momentum transfer between the coflowing fluids. The mixed solution is then exhausted into the ullage space of the propellant tank where evaporation of the atomized spray lowers the ullage gas temperature. In the embodiment of FIG. 6, the motive fluid is accelerated through an atomizer creating a highly atomized spray that has a temperature lower than that of the ullage generally. Because a non-condensable motive fluid is used, total pressure of the ullage is increased. By reducing or minimizing the thermal potential energy, e.g., the difference in temperature between the ullage gas and the temperature of the liquid cryogenic propellant, the degree by which the ullage pressure can collapse is reduced and the risk or ullage collapse is also reduced or perhaps eliminated.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

The features of the various embodiments described herein are not intended to be mutually exclusive when the nature of those features does not require mutual exclusivity. Instead, features and aspects of one embodiment may be combined with features or aspects of another embodiment. Additionally, the description of a particular element with respect to one embodiment may apply to the use of that particular element in another embodiment, regardless of whether the description is repeated in connection with the use of the particular element in the other embodiment.

Examples provided herein are intended to be illustrative and non-limiting. Thus, any example or set of examples provided to illustrate one or more aspects of the present disclosure should not be considered to comprise the entire set of possible embodiments of the aspect in question. Examples may be identified by use of the terms or phrases "for example," "such as," "by way of example," "e.g.," and other language commonly understood to indicate that what follows is an example.

What is claimed is:

1. An assembly for pumping fluids, comprising:

a. an ejector having a body, the body defining a suction chamber having a suction chamber inlet, and a nozzle extending from the ejector body, the ejector body configured to operate when the ejector body is submerged in a liquid volume;

b. the suction chamber inlet disposed within a liquid volume;

c. a valve disposed within the ejector body and in fluid communication with the liquid volume via the suction chamber, the valve having an open position that permits passage of the liquid volume to the suction chamber and a closed position that isolates the suction chamber from the liquid volume;

d. a motive fluid in fluid communication with the ejector, wherein transmission of the motive fluid at or above a threshold pressure causes an actuator of the valve to mechanically translate from the closed position to the open position by application of a motive fluid pressure to the valve and which motive fluid also causes a suction effect when passing through the nozzle which draws a portion of the liquid volume into the suction chamber, and the actuator is mechanically translated to the closed position by reducing the motive fluid pressure below the threshold pressure.

2. The assembly of claim 1, wherein the motive fluid is pressurized above the threshold pressure.

3. The assembly of claim 2, further comprising a pump in fluid communication with the motive fluid and configured to pressurize the motive fluid.

4. The assembly of claim 1, wherein the actuator of the valve comprises a mechanical actuator movable between a first position and a second position.

5. The assembly of claim 4, further comprising a valve body connected to the mechanical actuator, wherein when the mechanical actuator is in the first position, the valve is closed and when the mechanical actuator is in the second position the valve is open.

6. The system of claim 5, wherein the mechanical actuator comprises a piston movable between the first position and the second position and a stem interconnecting the piston with the valve body.

7. The system of claim 6, further comprising a biasing member that biases the piston to the first position and biases the valve to the closed position.

8. The assembly of claim 1, wherein the valve comprises a poppet valve.

9. The assembly of claim 1, wherein the valve comprises a globe valve.

10. The system of claim 1, further comprising a syphon tube having a first end and a second end spaced from the first end, wherein the first end is in fluid communication with the valve inlet and the second end is configured to be in fluid communication with a liquid propellant.

* * * * *